US006547106B2

(12) United States Patent
Bonningue

(10) Patent No.: US 6,547,106 B2
(45) Date of Patent: Apr. 15, 2003

(54) PUMP FOR DISPENSING A PRODUCT

(75) Inventor: Philippe Bonningue, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/779,622

(22) Filed: Feb. 9, 2001

(65) Prior Publication Data

US 2001/0017305 A1 Aug. 30, 2001

(30) Foreign Application Priority Data

Feb. 9, 2000 (FR) ..... 00 01594

(51) Int. Cl.[7] ..... B65D 37/00

(52) U.S. Cl. ..... 222/213; 222/207; 222/490; 222/494; 137/512

(58) Field of Search ..... 222/207, 213, 222/189.09, 382, 94, 490, 494, 444, 449, 450; 137/512

(56) References Cited

U.S. PATENT DOCUMENTS

| | | | | |
|---|---|---|---|---|
| 2,772,817 A | | 12/1956 | Jauch | |
| 3,160,329 A | * | 12/1964 | Radic et al. | 222/207 |
| 3,973,700 A | | 8/1976 | Schmidt et al. | |
| 4,088,248 A | | 5/1978 | Blake | |
| 4,336,895 A | | 6/1982 | Aleff | |
| 4,489,861 A | * | 12/1984 | Saito et al. | 137/512.4 |
| 4,646,945 A | * | 3/1987 | Steiner et al. | 222/207 |
| 5,014,881 A | | 5/1991 | Andris | |
| 5,462,208 A | * | 10/1995 | Stahley et al. | 222/207 |
| 5,829,640 A | | 11/1998 | Hershey et al. | |
| 6,089,260 A | * | 7/2000 | Jaworski et al. | 137/512 |
| 6,406,207 B1 | * | 6/2002 | Wiegner et al. | 222/207 |

FOREIGN PATENT DOCUMENTS

| | | |
|---|---|---|
| DE | 38 28 811 | 3/1989 |
| WO | WO 95/00253 | 1/1995 |

* cited by examiner

*Primary Examiner*—Gene Mancene
*Assistant Examiner*—Thach Bul
(74) *Attorney, Agent, or Firm*—Finnegan, Henderson, Farabow, Garrett & Dunner

(57) ABSTRACT

A pump for use with a device for containing and dispensing a product may include a single-piece vessel of unitary construction defining a variable-volume chamber. The vessel may include a first wall and a second wall. The pump may include an inlet slit on the first wall, the inlet slit being configured to open one way in response to a decreased pressure in the chamber. The pump may also include an outlet slit on the second wall, the outlet slit being configured to open one way in response to an increased pressure in the chamber. The vessel may be configured to deform from a first position occupying a first volume to a second position occupying a second volume in response to a pressure applied to the vessel. The pump may be used in combination with a container to form a device for containing and dispensing a product.

61 Claims, 3 Drawing Sheets

PUMP FOR DISPENSING A PRODUCT

Figure 1:
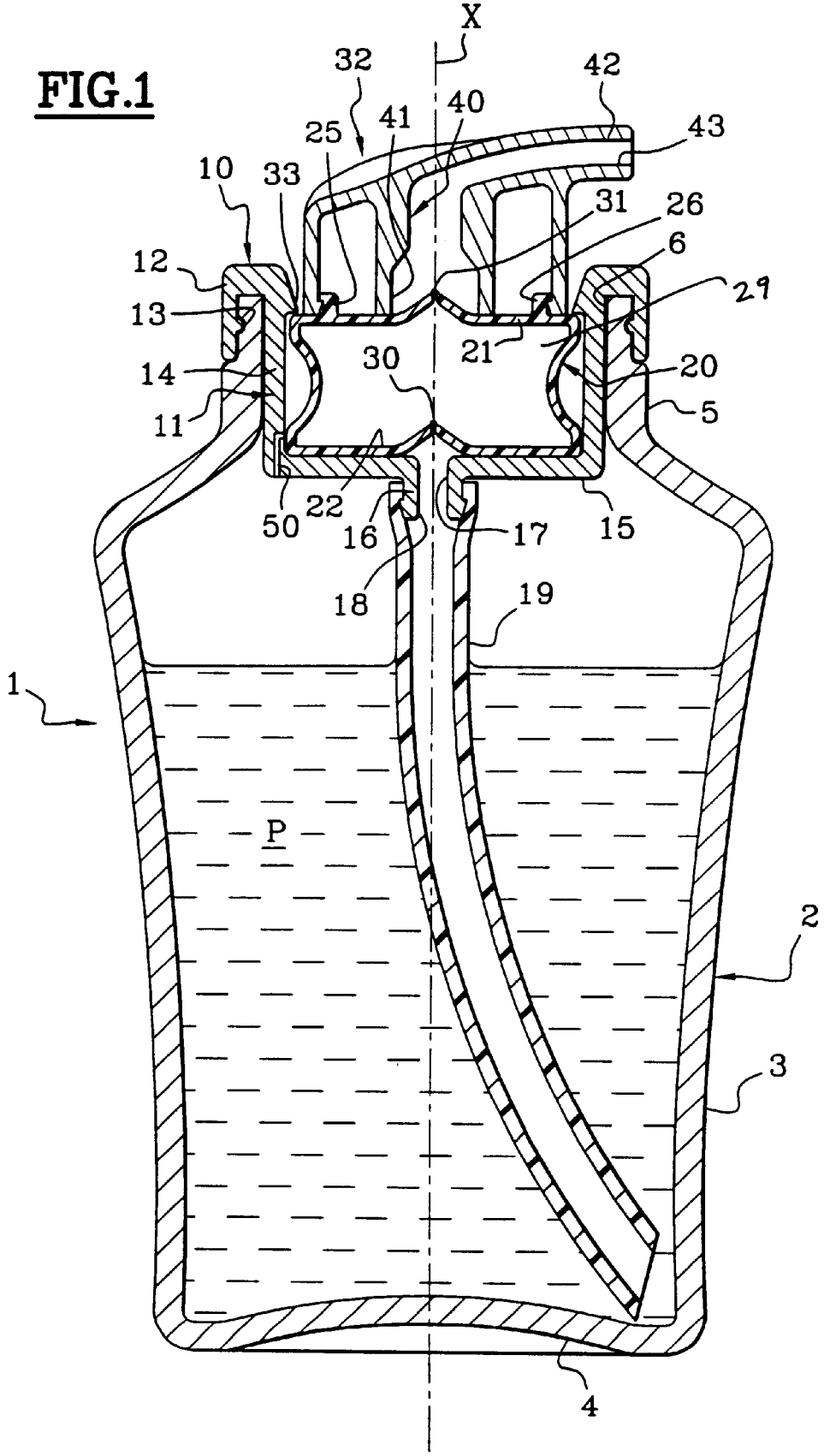

The present invention relates to a pump intended for dispensing a liquid or semi-liquid product, particularly a cosmetic or dermo-pharmaceutical product. Such a product may be in the form of a milk, an emulsion, a gel, or a cream. The invention also relates to a device for containing and dispensing a product including such a pump.

U.S. Pat. No. 3,973,700 discloses a sprayer having a body obtained by molding a plastic or a rubber. The body contains a chamber and has a pump including a bellows piston assembly. The bellows allows the volume of the chamber to be varied. The body also contains a nondeformable portion located opposite the bellows, in which two orifices are formed. The orifices are closed off by two flaps obtained by molding with the body. In the closed position, the flaps rest on a seat formed by the edge of the orifice with which they are associated. One of the flaps is formed inside the chamber, and the other is formed outside the chamber. Because of the configuration and positioning of the flaps, the body is molded in the open position, and is closed when mounted on the pump. This configuration poses sealing problems in the chamber closure region, making the fitting of such a pump appreciably more complicated.

Furthermore, because of demands associated with the molding of such flaps, the flaps are positioned in such a way that their one-way operation is not optimal. In particular, the inlet flap is arranged on a wall directed at approximately 45° with respect to the direction of the actuating force that has to be exerted on the bellows-forming part via a trigger. This arrangement carries the risk of opening slightly under the effect of a raised pressure in the chamber, thus appreciably minimizing the performance of such a pump.

Other bellows-type mechanisms are known, for example, International Application No. WO 95/00253 and U.S. Pat. No. 5,829,640. In these documents, the inlet and outlet orifices are closed by flaps in the form of attached elements separate from an elastically deformable part that forms at least part of the chamber. This arrangement results in a pump that is complicated to fit and expensive to implement.

A pump having a portion of rubber that is formed by assembling two or more parts, is described in U.S. Pat. No. 2,772,817. The pump disclosed in this reference may suffer from one or more of the disadvantages described above.

According to one aspect of the invention, a pump may include a single-piece vessel of unitary construction defining a variable-volume chamber. The vessel may include a first wall and a second wall. The first wall may include an inlet slit formed therein, and the second wall may include an outlet slit formed therein. The inlet slit may be configured to open one way in response to a decreased pressure in the chamber, and the outlet slit may be configured to open one way in response to an increased pressure in the chamber.

In one embodiment, the vessel may be configured to deform from a first position occupying a first volume to a second position occupying a second volume in response to a pressure applied to the vessel. The first volume may be a maximum and the second volume may be a minimum. Optionally, the pump may include an actuating member configured such that a pressure on the actuating member transmits the pressure to the vessel.

The vessel may be formed, for example, in its entirety from a single molded piece of material in which the inlet and outlet slits are formed, for example, by cutting or molding.

According to another aspect of the invention, a pump for use with a device for containing and dispensing a product may include a body member and a vessel mounted on the body member in a partially-compressed or deformed, first position (i.e., different from a non-compressed, rest position). The vessel may define a variable-volume chamber and may include a first wall and a second wall. The pump may also include an inlet slit on the first wall and an outlet slit on the second wall. The inlet slit may be configured to open one way in response to a decreased pressure in the chamber, and the outlet slit may be configured to open one way in response to an increased pressure in the chamber.

Within the meaning of the present invention, the term "slit" may denote an opening obtained by cutting or molding, and of which the edges that delimit the opening are capable of closing it in a substantially sealed manner. In the case of a slit formed by cutting, the cut may be made at right angles to a plane including the wall of the vessel having the slit (i.e., the plane of the slit). Alternately, the cut may be made at another angle. Such a slitted structure may differ from a structure disclosed in U.S. Pat. No. 3,973,700, in which each of inlet and outlet openings consists of a hole having edges that are not capable of closing the opening, but instead form a seat for a flap molded over the plane of the hole, wherein the surface area of the flap is greater than the surface area of the hole.

When the slits of the invention are in the closed position, the edges of the slit may be configured more or less contiguously (i.e., substantially butted up) such that the slits should seal the product off. Thus, in the case of a product of high viscosity, sealing may be achieved in spite of edges that are not completely contiguous. Conversely, in the case of products of low viscosity, contiguous edges may be needed. Optionally, the slit may also be airtight so as to make the pump easier to prime. The substantially contiguous slit arrangement, with the edges abutting more or less tightly in the closed position, may be enhanced by subjecting the slit to a lateral load, that is, one parallel to the plane of the slit.

The edges of such a slit may be capable of parting at right angles to the plane of the slit so as to open the slit in response to a pressure exerted on one side of the slit by the product that is to be dispensed. The edges may return to their closed position when the pressure ceases. When pressure is exerted on the other side of the slit, the edges delimiting the slit may come into abutment against one another to oppose the opening of the slit. The one-way nature of the slit can be obtained by preforming and/or loading the edges of the slit in such a way as to give them an orientation, with respect to a plane substantially including the wall in which the slit is made, that determines the direction in which the slit opens. For example, the slit may be biased closed by preloading the wall of the vessel with a lateral preload.

The slit may be of any shape. For example, the slit may be of elongate shape, or in the shape of a cross or of a star.

Thus, by making the inlet and outlet orifices in the form of slits, a structure may be achieved that can be molded directly in the required shape to form the vessel, that is, in the form of a closed volume in which all that will be necessary will be for the slits to be made, for example, by cutting. The vessel may thus be mounted on the pump body member without the need to produce sealing, other than at the point where the vessel is itself mounted on the body member and where an actuating member is mounted on the vessel.

Optionally, the vessel may be molded in the form of a closed structure in which the inlet and outlet slits are cut. This characteristic, relating to molding in the form of a closed volume, makes it possible to reduce the amount of sealing that has to be achieved when fitting the pump.

By way of example, the vessel may be molded in the form of a cylinder of revolution having two closed ends. One slit may be cut essentially at the center of each of the ends. A structure such as this can be obtained by rotary molding. The cross section of the vessel may be circular, a square, triangular, hexagonal, or another appropriate shape.

The vessel may be elastically deformable, for example, because of its configuration, such as in the form of a bellows, or because of the material of which it is made, such as an elastomeric material, or for both reasons. Thus, the vessel can return to the first position by elastic return exerted by the vessel itself. Alternatively, an auxiliary spring may cause this return.

In one embodiment, the first and second walls of the vessel may be located opposite from one another. Optionally, the first and second walls may be essentially perpendicular, on the one hand, to the direction of the force to be exerted in order to actuate the pump and, on the other hand, to the axis of a passage via which product arrives in the pump. This configuration may be utilized to enhance the one-way operation of the slits. Furthermore, such an arrangement of the slits may make it possible to obtain a pump that is more ergonomic, as well as simpler and more economical to produce. Also, the inlet and outlet slits may be aligned along an axis of the vessel (e.g., a longitudinal axis of the vessel.).

The vessel may be made of a material chosen from thermoplastic and polymerized elastomers. The material may be chosen from nitriles, silicones, natural and synthetic latices, EPDMs, polyurethanes, blends of polypropylene and one of SIBS, SEBS and EPDM, very-low-density polyethylenes, blends based on polyester glycols (TPU), blends based on polyether glycols (PEBA and COPE), and flexible polyvinyl chlorides (PVC). Such a material may have a hardness of, for example, from 20 Shore A to 40 Shore D, and optionally from 40 Shore A to 75 Shore A. The elasticity of the material may range, for example, from 0.5 to 5 MPa and optionally from 0.8 to 2 MPa (tensile stress at 100% elongation).

According to another embodiment, the deformation of the vessel from the first position to the second position may result from an elastic deformation of at least one side wall separating (i.e., between) the first and second walls. The deformation may be in response to pressure exerted on the vessel, optionally by way of an actuating member, and the return of the vessel to the first position may be by elastic return of the side wall thus deformed.

The vessel may be placed inside a rigid or semi-rigid body member. The body member may include a snap-fastener or screw-fastener, allowing the pump to be fixed onto a container containing a product that is to be dispensed. A body member such as this may be made of polypropylene or polyethylene. The body member may include a passage having one end that opens proximal to the inlet slit of the vessel, and another end that opens into the container. Optionally, a dip tube may be mounted on the passage, for example, by force-fitting. A free end of the dip tube may be arranged essentially at the bottom of the container.

According to yet another embodiment of the invention, the vessel may be mounted on the body member of the pump with an axial preload causing predeformation of the side walls so as to form a convexity into the vessel when viewed from an inside of the vessel. Such predeformation may be configured to encourage or assist the vessel to deform from the first position to the second position. Optionally, at the time of molding, the vessel may be preformed so that the side walls have a slightly convex shape when viewed from inside the vessel when the vessel is in a non-compressed, rest position. The convex shape may be accentuated at the time of assembly by the axial load.

According to another embodiment of the invention, the vessel may be mounted on the body member of the pump with a lateral preload configured to bias the inlet and outlet slits toward a closed position (i.e., encourage or assist the one-way nature of the slits). The inlet slit may be delimited by at least two edges, the edges being, under the effect of the lateral preload, moved with respect to the mean plane of the first wall inward with respect to the variable-volume chamber. With a configuration such as this, the edges delimiting the inlet slit may be capable, in response to a raised pressure in the chamber, of coming into abutment against one another so as to prevent the slit from opening towards the container. The movement of the edges of the slit towards the inside of the vessel may be encouraged or assisted by preforming of the vessel, for example, at the time of molding.

In the same way, the outlet slit may be delimited by at least two edges. The edges under the effect of the lateral preload may be moved with respect to the mean plane of the second wall, outward with respect to the chamber, toward the actuating member. Thus, in response to decreased pressure in the chamber, the edges delimiting the outlet slit may be capable of coming into abutment against one another so as to prevent the outlet slit from opening toward the inside of the vessel. The outward movement, with respect to the vessel, of the edges of the slit may be encouraged or assisted by preforming of the vessel, for example, at the time of molding.

The first wall and/or the second wall may be preformed, such as at the time of molding of the vessel, so as to encourage or assist the edges of the corresponding slit to move as desired in response to the lateral preload.

A passage may be provided to allow air to be taken into the container when the vessel returns from the second position to the first position. Such a passage may be made in the body member of the pump, with a first end of the passage opening into the container and a second end of the passage being closed off by the vessel when the latter is in the first position. The passage may be at atmospheric pressure when the vessel is in the second position.

The vessel may be fixed, for example, by bonding or welding, on the body member of the pump. Optionally, the vessel may be fixed inside the body member. Alternatively, the vessel may be force-fitted into the pump body member, and thus held by clamping.

The actuating member of the pump may be configured in the form of a push-button. The actuating member may include a passage, of which a first end opens facing adjacent to the outlet slit of the vessel and a second end opens to at least one product-dispensing orifice. Such a push-button may be formed, for example, of a thermoplastic material such as the polyethylene or polypropylene type or of an elastomeric material identical to or different from the material that forms the vessel. The pump according to the invention may include means capable, in a so-called "transport" position, of preventing its operation. Such means are well known and therefore require no additional detailed description.

According to another aspect, the invention may include a device for containing and dispensing a product. The device may include a container configured to contain a product and a body member attached on the container. A vessel defining a variable-volume chamber may be mounted on the body member. The vessel may include a first wall and a second wall. The device may also include an air passage on the body member. The air passage may include a first end and a second end. The first end may open into the container, and the second end may be selectively opened and closed by the vessel. An inlet slit may be on the first wall of the vessel, and an outlet slit may be on the second wall. The inlet slit may be configured to open one way in response to a decreased pressure in the chamber, and the outlet slit may be configured to open one way in response to an increased pressure in the chamber.

In one embodiment of the device, the vessel may be configured to deform from a first position occupying a first volume to a second position occupying a second volume in response to a pressure applied to the vessel. The second end of the air passage may be closed off by the vessel when the vessel is in the first position, and the second end may be opened to atmospheric pressure when the vessel is in the second position. In another embodiment, the body member may be fixedly attached on the container, for example, by snap-fastening or screw-fastening.

In yet another embodiment, the body member may include an additional passage. The additional passage may include a first end opening proximal to the inlet slit and a second end opening into the container. The device may optionally include a dip tube mounted on and/or in flow communication with the additional passage. The dip tube may include a free end configured to extend substantially to a bottom of the container.

The container may contain, for example, a cosmetic or dermo-pharmaceutical product, such as a hair product, a sun-protection product, a personal hygiene product, a make-up product, and/or a care product. The product may be, for example, in the form of a milk, an emulsion, a gel, or a cream.

According to yet aspect of the invention, a method of dispensing a product may include providing a pump as described above, actuating the pump to dispense product from a container, and directing the dispensed product to a surface region. The surface region may be, for example, an external body member portion. The product may be, for example, a cosmetic or dermo-pharmaceutical product, such as a hair product, a sun-protection product, a personal hygiene product, a make-up product, and/or a care product. The product may be, for example, in the form of a milk, an emulsion, a gel, or a cream.

Apart from the provisions explained hereinabove, the invention may include a certain number of other arrangements that will be dealt with more fully hereinafter with regard to some embodiments that are described with reference to the drawings appended hereto, but which are not in any way limiting. It is to be understood that both the foregoing description and the following description are exemplary, and are intended to provide further explanation of the invention as claimed.

Figure 2:
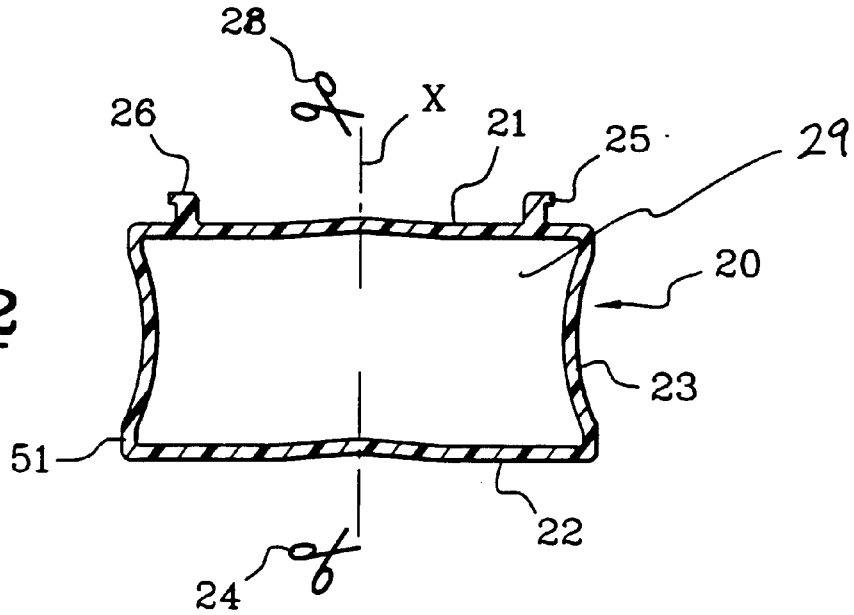
Figure 3:
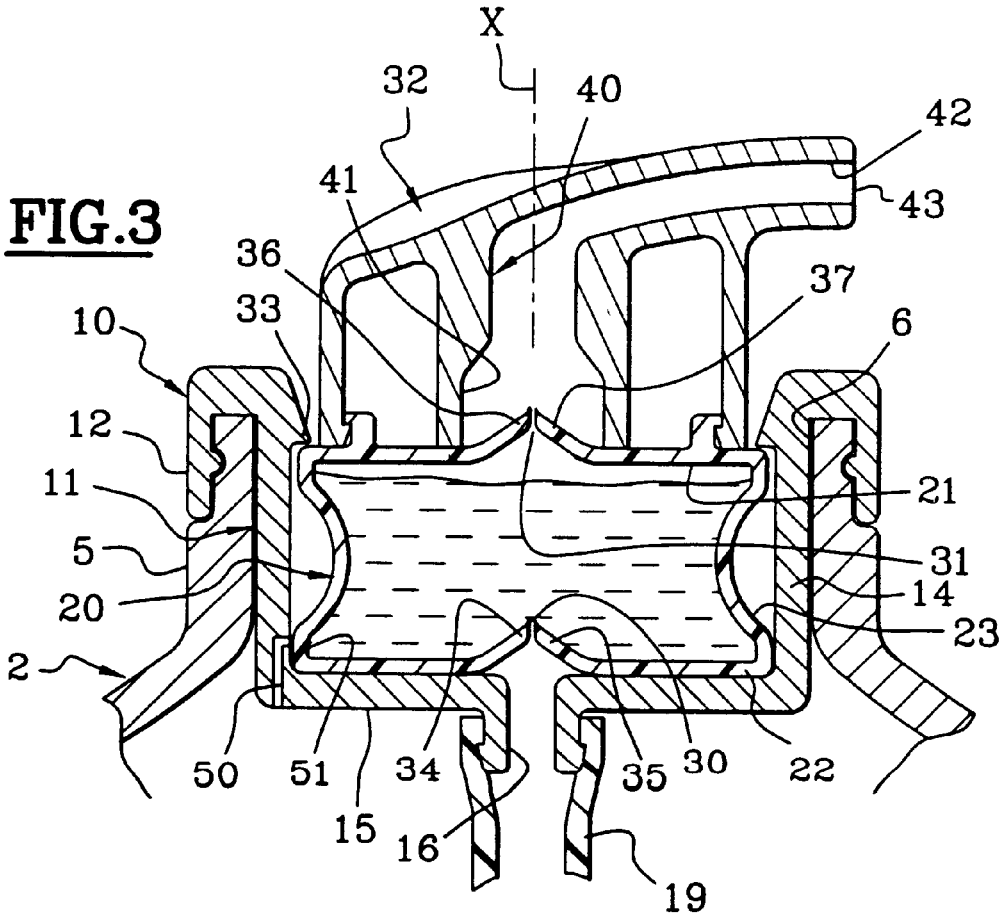
Figure 4:
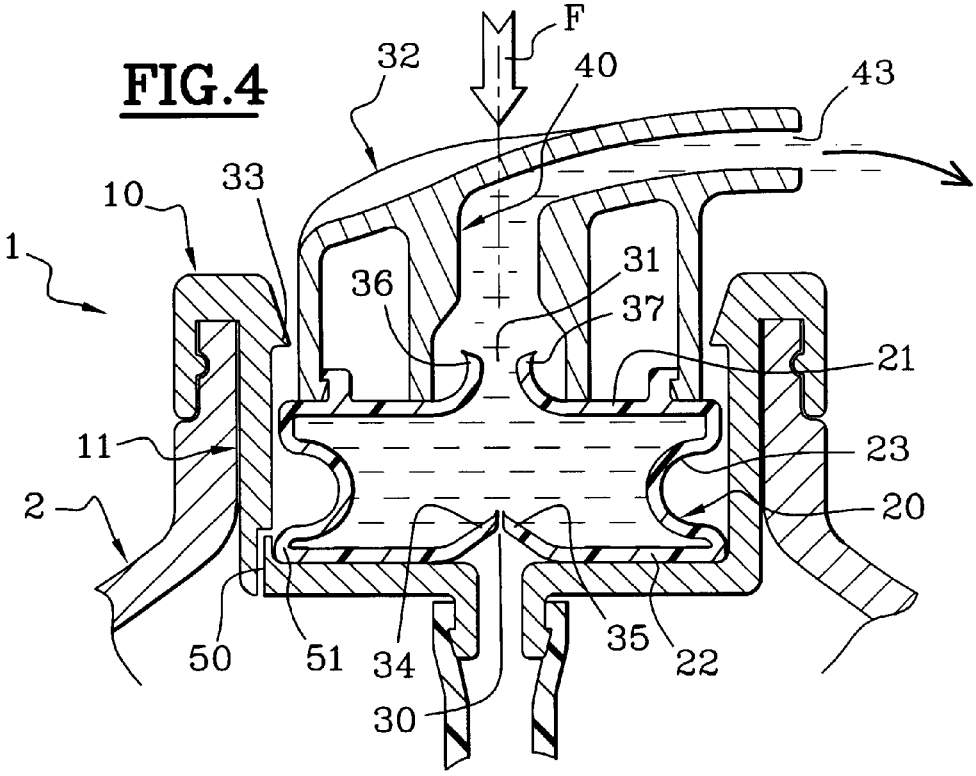
Figure 5:
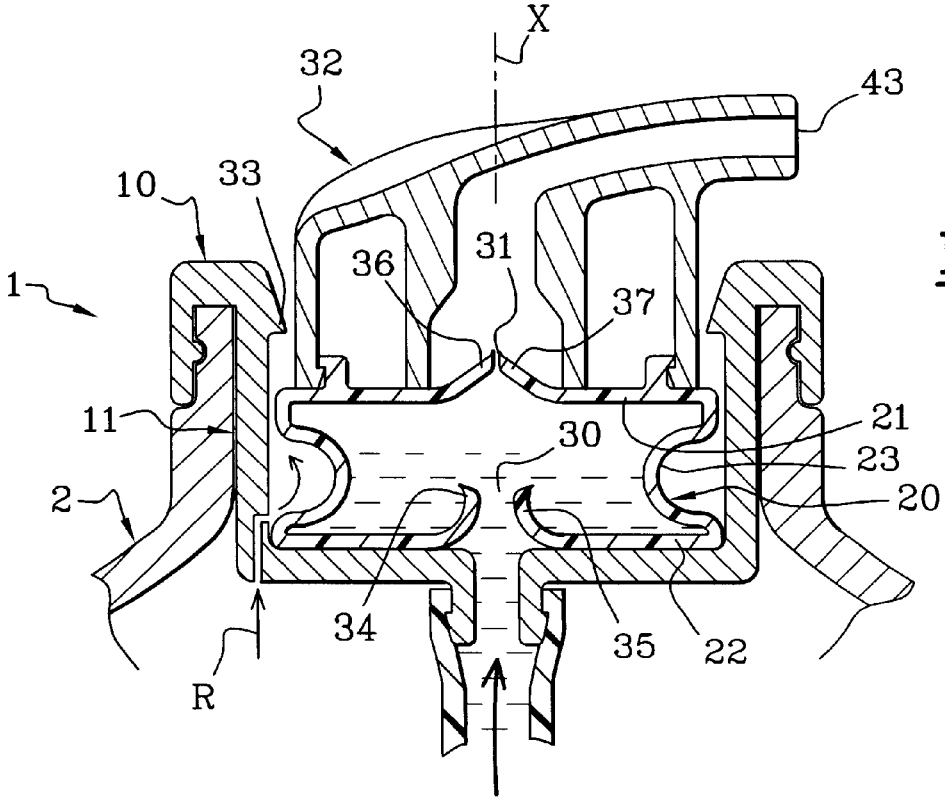

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a cross-sectional view of a device for containing and dispensing a according to an embodiment of the invention;

FIG. 2 is a cross-sectional view of a vessel used in the device of FIG. 1; and FIGS. 3–5 illustrate the operation of the device of FIG. 1.

Reference will now be made in detail to the present preferred embodiments of the invention, examples of which are illustrated in the accompanying drawings. Wherever possible, the same reference symbols are used in the drawings and the description to refer to the same or like parts.

An exemplary embodiment of a device for containing and dispensing a product is shown in FIG. 1, and is designated generally by reference numeral 1. As embodied herein and referring to FIG. 1, the device may include a container 2 and a pump 10.

The container 2 may be formed, for example, of polyethylene or polypropylene. The container 2 may contain a product P, such as a cosmetic or dermo-pharmaceutical product, for example, a hair product, a sun-protection product, a personal hygiene product, a make-up product, or a care product. The product can be dispensed onto a surface region, for example, an external body member portion. The product may be, for example, in the form of a milk, an emulsion, a gel, or a cream. By way of example, the product P may be a hair product, such as a shampoo, that is to be dispensed on an external body member portion including hair.

The container 2 includes a longitudinal axis X. The container 2 may also includes a body member 3, one end of which is closed by a bottom 4, and another end of which ends in a neck 5, a free end of the neck 5 delimiting an opening 6. The pump 10 may be mounted on the neck 5, for example, by snap-fastening or screw-fastening. The pump 10 may be located along the longitudinal axis X of the container 2.

The pump 10 may include a body member 11 made, for example, of polypropylene. The body member 11 may include a rim 12, an internal surface of which has a bulge 13 configured to facilitate mounting of the pump 10 on the container 2 by, for example, snap-fastening. Alternatively, the pump 10 could be screwed onto the neck 5 of the container 2.

The body member 11 of the pump 10 may include a lateral skirt 14, one end of which may be at least partially closed by an end wall 15. The end wall 15 may be coupled at its center to a hollow axial shaft 16, one end 17 of which opens into the body member 11 of the pump 10 and the other end 18 of which opens into the container 2. A dip tube 19 may be forcibly fitted onto the hollow shaft 16. A free end of the dip tube 19 may be located essentially near the bottom 4 of the container 2. The end of the body member 11 opposite the end wall 15 may be open. A vessel 20 may be mounted on the body member 11 of the pump 10.

The vessel 20 may define a variable-volume chamber 29. The vessel 20 may be formed, for example, by molding an elastomeric material chosen to be compatible with the product that is to be dispensed. According to one embodiment, a nitrile elastomer is used.

FIG. 2 depicts the vessel 20 as it leaves a mold, that is, in a non-compressed, rest position. In this configuration, the shape of the vessel 20 may substantially resemble a cylinder closed at ends 21, 22. The body 23 of the vessel 20 may be preformed, for example, at the time of molding, so that the vessel 20 is slightly convex when viewed from an inside of the vessel 20. The ends 21 and 22 may be preformed at the time of molding so that their center is slightly raised with respect to their mean plane (i.e., a plane substantially including the respective end walls). Such preforming operations, as will be described in detail later, on the one hand encourage or assist the elastic deformation of the vessel 20 and, on the other hand, encourage or assist the one-way opening of the inlet and outlet slits 30, 31 (FIG. 1). The inlet and outlet slits 30, 31 may be made, for example, after molding by cutting end walls 21, 22 essentially at the center of each (as illustrated diagrammatically by the scissors 24, 28). Means 25, 26 are provided to allow mechanical attachment of an actuating device, for example, push-button 32 (FIG. 1). Optionally, a vessel as depicted in FIG. 2 may be obtained by rotary molding.

When the pump 10 is assembled, the vessel 20 may be on the body member 11 such that the slit 30 faces the hollow axial shaft 16. Likewise, the slit 31 may face a first end 41 of a passage 40 formed inside the push-button 32. The other end 42 of the passage 40 may open to the outside of the push-button 32 via at least one dispensing orifice 43. The vessel 20 and the pump body member 11 are optionally dimensioned so that the vessel 20, in the first position illustrated in FIG. 1, may be preloaded axially and/or laterally. For this purpose, an annular end stop 33 may be formed on the interior surface of the side wall 14 of the body member 11 of the pump 10. The end stop 33 may be arranged some distance from the end wall 15. This distance may be less than the axial height of the vessel 20 in the as-molded condition. Thus, when the vessel 20 is under the end stop 33, the convexity formed by the body member 23 of the vessel 20 may be accentuated appreciably, thus correspondingly encouraging deformation of the vessel 20 when pressure is exerted on the push-button 32. Alternatively, the axial preload of the vessel 20 may be obtained by engaging a means, for example, a rib, carried by the push-button 32 with the annular end stop 33.

The inside diameter of the body member 11 of the pump 10 may be slightly smaller than the outside diameter of the vessel 20 in the as-molded condition. Thus, when the vessel 20 is mounted on the body member 10 of the pump, the vessel 20 may be subjected to a load exerted radially towards its center. As shown in FIG. 3, this radial (i.e., lateral) load may result in deformation of the edges 34, 35 and 36, 37, respectively, delimiting the inlet and outlet slits 30, 31. This deformation may be encouraged or assisted by the preforming obtained, for example, at the time of molding of the vessel 20. Thus, the edges 34, 35 delimiting the inlet slit 30 may be forced inwards with respect to the vessel 20 and may be in abutment against one another. The edges 34, 35 thus kept in abutment above the mean plane of the wall 22 of the vessel 20 may allow the slit 30 to open inward with respect to the variable-volume chamber 29 when there is a depression (i.e., decrease in pressure) therein. By contrast, the edges 34, 35 may oppose the opening of the slit 30 in the opposite direction when there is a raised pressure inside the vessel.

The edges 36, 37 delimiting the outlet slit 31 may be forced outwards with respect to the variable-volume chamber 29, towards the push-button 32 and may be in abutment against one another. The edges 36, 37 thus held in abutment above the mean plane of the wall 21 of the vessel 20 thus may allow the slit 31 to open outward with respect to the variable-volume chamber 29 when there is a raised pressure therein. By contrast, the edges 36, 37 oppose the opening of the slit 31 in the opposite direction when there is a depression (i.e., decreased pressure) in the vessel 20.

The vessel 20 may be attached on the body member 11 of the pump, for example, by bonding or welding. For example, the wall 22 of the vessel 20 may be secured on the end wall 15 of the body member 11 of the pump 10. Optionally, the bonding or welding may be performed in a continuous run all around the slit 30 so as to form a seal between the body member 11 of the pump 10 and the vessel 20. The seal between the vessel 20 and the push-button 32 may be obtained by bonding or welding also, or by any other appropriate means.

The bottom part of the body member 11 of the pump 10 may include an air intake passage 50. A first end of the passage 50 may open into the container 2. A second end of the passage 50 may face a lower cylindrical portion 51 of the vessel 20 when the vessel 20 is not in its minimum-volume position. When the vessel 20 is in its minimum volume position, the second end of the passage 50 may be uncovered because of the maximum compression of the vessel 20, thus allowing air to be taken into the container 2.

FIGS. 3 to 5 illustrate the operation of the pump according to the invention. In FIG. 3, the pump is depicted in the partially-compressed, first position, and the vessel is filled with product. Because the pressures inside and outside the pump 10 are balanced, the inlet 30 and outlet 31 slits are closed.

In FIG. 4, in response to a force F exerted along the axis X of the device, the vessel 20 may be compressed until it reaches minimum volume. In so doing, the outlet slit 31 opens towards the outside of the vessel 20 in response to the raised pressure in the variable-volume chamber 29. The product contained in the vessel 20 is conveyed into the passage 40 of the push-button 42 and is dispensed via the dispensing orifice 43. The orientation of the edges 34 and 35 of the inlet slit 30 is such that the edges 34, 35 oppose the opening of the slit 30 towards the container 2 in spite of the pressure in the variable-volume chamber 29. In the position of maximum compression of the vessel 20, the air intake passage 50 is no longer covered by the cylindrical part 51 of the vessel 20.

In FIG. 5, the user has released the pressure on the pushbutton 32. The outlet slit 31 closes again by elastic return of its edges 36, 37. Under the elastic return force generated by the deformed portion 23 of the vessel 20, the vessel 20 decompresses, so as to resume its maximum-volume position (FIG. 3). During this expanding movement of the vessel 20, a depression or decreased pressure is created in the variable-volume chamber 29, thereby causing the inlet slit 30 to open toward the inside of the vessel 20 and pumps a dose of product from the container 2 into the variable-volume chamber 29. The volume of product pumped from the container 2 is compensated for by a corresponding volume of air (the flow of which is illustrated by the arrow R) entering the container 2 via the air intake passage 50 before the passage 50 is once again closed by the portion 51 of the vessel 20. The orientation of the edges 36, 37 delimiting the outlet slit 31 is such that the latter cannot open inwards in spite of the depression (i.e., lowered pressure) in the variable-volume chamber 29. The expanding movement of the vessel 20 continues until the wall 21 of the vessel 20 comes into abutment against the end stop 33. When the pressures are balanced, the slit 30 closes again. The pump 10 is therefore ready to dispense the dose of product thus accumulated in the vessel 20.

It is obvious that the parameters governing the production of the pump, and particularly the amount of axial and radial preload on the vessel and the characteristics of the material of which the vessel 20 is formed, are tailored, in particular, to suit the volume of the vessel and the viscosity of the product that is to be dispensed.

Other embodiments of the invention will be apparent to those skilled in the art from consideration of the specification and practice of the invention disclosed herein. It is intended that the specification and embodiments be considered as exemplary only, with a true scope and spirit of the invention being indicated by the following claims.

What is claimed is:

1. A pump for use with a device for containing and dispensing a product, comprising:

a single-piece vessel of unitary construction defining a variable-volume chamber, the vessel including a first wall and a second wall;

an inlet slit formed in the first wall, the inlet slit being configured to open one way in response to a decreased pressure in the chamber; and an outlet slit formed in the second wall, the outlet slit being configured to open one way in response to an increased pressure in the chamber.

2. The pump of claim 1, wherein the vessel is configured to deform from a first position occupying a first volume to a second position occupying a second volume in response to a pressure applied to the vessel, the first volume being larger than the second volume.

3. The pump of claim 2, wherein the first volume is a maximum volume and the second volume is a minimum volume.

4. The pump of claim 2, further comprising an actuating member, wherein a pressure on the actuating member applies the pressure to the vessel.

5. The pump of claim 4, wherein the actuating member includes a passage, the passage including a first end proximal the outlet slit of the vessel and a second end configured to dispense a product.

6. The pump of claim 4, wherein the actuating member is a push-button.

7. The pump of claim 4, wherein the actuating member includes a thermoplastic material.

8. The pump of claim 7, wherein the thermoplastic material includes an elastomeric material.

9. The pump of claim 2, further comprising a body member configured to maintain the vessel partially-compressed in the first position.

10. The pump of claim 9, wherein the body member includes an air passage, the air passage being closed by the vessel when the vessel is in the first position.

11. The pump of claim 9, wherein the vessel is fixedly attached on the body member.

12. The pump of claim 11, wherein the vessel is fixedly attached in the body member.

13. The pump of claim 11, wherein the vessel is attached by one of clamping, bonding, and welding.

14. The pump of claim 1, wherein the vessel includes a bellows.

15. The pump of claim 1, wherein the vessel includes an elastomeric material.

16. The pump of claim 1, wherein the first wall and the second wall oppose one another.

17. The pump of claim 1, wherein the inlet slit and the outlet slit are substantially aligned with one another.

18. The pump of claim 1, wherein the inlet slit and the outlet slit are substantially aligned along an axis of the vessel.

19. The pump of claim 1, wherein the vessel includes a material chosen from thermoplastic elastomers and polymerized elastomers.

20. The pump of claim 19, wherein the material is chosen from nitriles, silicones, natural and synthetic latices, EPDMs, polyurethanes, blends of polypropylene and one of SBS, SEBS, and EPDM, very-low-density polyethylenes, blends based on polyester glycols (TPU), blends based on polyether glycols (PEBA and COPE), and flexible polyvinyl chlorides (PVC).

21. The pump of claim 1, wherein the vessel includes at least one side wall between the first wall and the second wall, the at least one side wall being configured to deform from a first position to a second position in response to a pressure applied to the vessel.

22. The pump of claim 21, wherein the at least one side wall includes a convex shape when viewed from an inside of the variable-volume chamber and the vessel is in a non-compressed, rest position.

23. The pump of claim 21, wherein the at least one side wall is configured to elastically return to the first position in response to removal of the pressure applied to the vessel.

24. The pump of claim 21, further comprising a body member, the vessel being mounted on the body member with an axial preload, the first position including a partial deformation of the at least one side wall resulting from the preload, the partial deformation being configured to assist the at least one side wall in deforming from the first position to the second position in response to the pressure applied to the vessel.

25. The pump of claim 24, wherein the at least one side wall deforms convexly when viewed from an inside of the variable-volume chamber.

26. The pump of claim 21, further comprising a body member, the vessel being mounted on the body member with a lateral preload, the lateral preload being configured to assist the one-way opening of the inlet slit and the outlet slit of the vessel.

27. The pump of claim 26, wherein the inlet slit is delimited by a pair of edges on the first wall and the outlet slit is delimited by a pair of edges on the second wall, at least one of the first wall and the second wall being configured to bias the pair of edges of the respective slit toward one another in response to the lateral preload.

28. The pump of claim 27, wherein the first wall is configured to bias the pair of edges of the inlet slit toward one another in response to the lateral preload, the pair of edges being configured to abut one another to prevent the inlet slit from opening in response to an increased pressure in the variable-volume chamber.

29. The pump of claim 28, wherein the pair of edges of the inlet slit move toward an inside of the vessel.

30. The pump of claim 27, wherein the second wall is configured to bias the pair of edges of the outlet slit toward one another in response to the lateral preload, the pair of edges being configured to abut one another to prevent the outlet slit from opening in response to a decreased pressure in the variable-volume chamber.

31. The pump of claim 30, wherein the pair of edges of the outlet slit move toward an outside of the vessel.

32. A method of dispensing a product, comprising:

providing the pump of claim 1;

actuating the pump to dispense product from a container; and directing the dispensed product to a surface region.

33. The method of claim 32, wherein the surface region is an external body member portion.

34. The method of claim 33, wherein the external body member portion includes hair, and wherein the product is a hair care product chosen from a shampoo, a hairspray, a lacquer, a care cream, a gel, and a hair styling mousse.

35. The method of claim 32, wherein the product includes at least one of a cosmetic product and a dermo-pharmaceutical product.

36. The method of claim 35, wherein the product is one of a hair product, a sun-protection product, a personal hygiene product, a make-up product, and a care product.

37. The device for containing and dispensing a product, the device comprising:

a container for containing a product;

the pump of claim 1, the pump being on the container; and a dip tube within the container, the dip tube being flow coupled with the pump.

38. A pump for use with a device for containing and dispensing a product, comprising:

a body member;

a vessel defining a variable-volume chamber, the vessel including a first wall and a second wall, the vessel being on the body member in a partially-deformed, first position occupying a first volume, the first volume being a maximum volume;

an inlet slit on the first wall, the inlet slit being configured to open one way in response to a decreased pressure in the chamber; and an outlet slit on the second wall, the outlet slit being configured to open one way in response to an increased pressure in the chamber.

39. The pump of claim 38, wherein the vessel is configured to deform from the first position occupying the first volume to a second position occupying a second volume in response to a pressure applied to the vessel.

40. The pump of claim 39, wherein the second volume is a minimum volume.

41. The pump of claim 39, further comprising an actuating member, wherein a pressure on the actuating member applies the pressure to the vessel.

42. The pump of claim 38, wherein the vessel includes at least one side wall between the first wall and the second wall, the at least one side wall being configured to deform from the first position to a second position in response to a pressure applied to the vessel.

43. The pump of claim 42, wherein the at least one side wall is configured to elastically return to the first position in response to removal of the pressure applied to the vessel.

44. The pump of claim 42, wherein the vessel is mounted on the body member with an axial preload, the axial preload partially deforming the at least one side wall when the vessel is in the first position, the partial deformation being configured to assist the at least one side wall in deforming from the first position to the second position in response to the pressure applied to the vessel.

45. The pump of claim 44, wherein the at least one side wall deforms convexly when viewed from an inside of the variable-volume chamber.

46. The pump of claim 42, wherein the vessel is mounted on the body member with a lateral preload, the lateral preload being configured to assist the one-way opening of the inlet slit and the outlet slit of the vessel.

47. The pump of claim 46, wherein the inlet slit is delimited by a pair of edges on the first wall and the outlet slit is delimited by a pair of edges on the second wall, at least one of the first wall and the second wall being configured to bias the pair of edges of the respective slit toward one another in response to the lateral preload.

48. The pump of claim 47, wherein the first wall is configured to assist the pair of edges of the inlet slit to move toward an inside of the vessel in response to the lateral preload, the pair of edges being configured to abut one another to prevent the inlet slit from opening in response to an increased pressure in the variable-volume chamber.

49. The pump of claim 47, wherein the second wall is configured to assist the pair of edges of the outlet slit to move toward an outside of the vessel in response to the lateral preload, the pair of edges being configured to abut one another to prevent the outlet slit from opening in response to a decreased pressure in the variable-volume chamber.

50. The pump of claim 38, wherein the vessel is fixedly attached on the body member.

51. A device for containing and dispensing a product, comprising:

a container configured to contain a product;

a body member on the container;

a vessel defining a variable-volume chamber, the vessel including a first wall and a second wall, the vessel being on the body member;

an air passage on the body member, the air passage including a first end and a second end, the first end opening into the container, the second end being selectively opened and closed by the vessel;

an inlet slit on the first wall, the inlet slit being configured to open one way in response to a decreased pressure in the chamber; and an outlet slit on the second wall, the outlet slit being configured to open one way in response to an increased pressure in the chamber.

52. The device of claim 51, wherein the vessel is configured to deform from the first position occupying a first volume to a second position occupying a second volume in response to a pressure applied to the vessel, the first volume being larger than the second volume.

53. The device of claim 52, wherein the first volume is a maximum volume and the second volume is a minimum volume.

54. The device of claim 52, wherein the second end of the air passage is closed off by the vessel when the vessel is in the first position, and the second end is opened to atmospheric pressure when the vessel is in the second position.

55. The device of claim 51, wherein the body member is fixedly attached to the container by at least one of snap-fastening and screw-fastening.

56. The device of claim 51, wherein the container contains a product.

57. The device of claim 56, wherein the product includes at least one of a cosmetic product and a dermo-pharmaceutical product.

58. The device of claim 57, wherein the product is one of a hair product, a sun-protection product, a personal hygiene product, a make-up product, and a care product.

59. The device of claim 58, wherein the product is a hair product chosen from a shampoo, a hairspray, a lacquer, a care cream, a gel, and a hair styling mousse.

60. The device of claim 51, wherein the body member includes an additional passage, the additional passage including a first end opening proximal to the inlet slit and a second end opening into the container.

61. The device of claim 60, further comprising a dip tube mounted on the additional passage, the dip tube including a free end extending substantially to a bottom of the container.

* * * * *